US005893325A

United States Patent [19]

Sakai

[11] Patent Number: 5,893,325

[45] Date of Patent: Apr. 13, 1999

[54] SCREEN PRINTING APPARATUS

[75] Inventor: Akira Sakai, Gifu, Japan

[73] Assignee: Sakurai Graphic Systems Corporation, Tokyo, Japan

[21] Appl. No.: 08/943,083

[22] Filed: Oct. 2, 1997

[30] Foreign Application Priority Data

Oct. 7, 1996 [JP] Japan ..... 8-265932

[51] Int. Cl.[6] ..... B41F 15/46

[52] U.S. Cl. ..... 101/123; 101/484

[58] Field of Search ..... 101/114, 123, 101/124, 129, 126, 484

[56] References Cited

U.S. PATENT DOCUMENTS 5,479,854 1/1996 Chikahisa et al. ..... 101/123

5,483,884 1/1996 Vellanki ..... 101/123

*Primary Examiner*—Ren Yan

*Attorney, Agent, or Firm*—Crompton, Seager & Tufte, LLC

[57] ABSTRACT

There is disclosed a screen printing apparatus comprising a squeegee arranged above a screen in a manner opposed to the screen, the squeegee being supported such that the squeegee is movable in a vertical direction and at the same time movable in a direction of printing of a printing material, a plurality of urging devices arranged on a supporting frame supporting the squeegee in a manner suspended therefrom, for urging the squeegee toward the screen, an urging force-detecting device for detecting urging forces of the urging devices during movement of the squeegee for printing, and a first control device for controlling the urging devices based on results of detection by the urging force-detecting device to adjust urging forces applied by the urging devices to the squeegee.

20 Claims, 9 Drawing Sheets

SCREEN PRINTING APPARATUS

BACKGROUND OF THE INVENTION

1. Field of the Invention

This invention relates to a screen printing apparatus, and more specifically to a screen printing apparatus which is capable of holding a squeegee thereof in a level state.

2. Description of the Related Art

Conventionally, a screen printing apparatus is known as one of printing apparatuses which print (coat) a printing material (coating material) formed by a thin piece such as a sheet of paper. In the screen printing apparatus, a squeegee slides on a screen having ink placed thereon from a printing start side to a printing end side whereby the printing material placed on a printing table is printed. Further, after the printing, a scraper slides on the screen from the printing end side to the printing start side to thereby scrape ink remaining on the screen back to the printing start side. And then, these operations are repeatedly carried out in an alternating manner to thereby print a plurality of printing materials in succession.

That is, in the screen printing apparatus, the printing table on which a printing material such as a sheet of paper is placed is arranged in a vertically movable manner, and a carrying gripper carries the printing material onto the table. During the printing, the printing material is held on the printing table by vacuum.

The screen which is masked in a predetermined manner is arranged over the printing table in a vertically movable manner. Above this screen, the squeegee and the scraper are positioned in a manner opposed to each other. The squeegee and the scraper are each arranged in a vertically movable manner such that each of them can be brought into or kept from contact with the screen. Further, the squeegee and the scraper are both horizontally movable above the screen.

As shown in FIG. 8, during the scraping process after the printing, the printing table 81 and the screen 82 have been moved away from each other. The scraper 83 has been moved to a position in which it is in lightly urging contact with the screen 82, whereas the squeegee 84 has been moved to a position away from the screen 82. In this state, the squeegee 84 and the scraper 83 are moved horizontally from the printing end side to the printing start side, whereby ink 85 remaining on a masking portion of the screen 82 is scraped away. The ink 85 scraped in this way is collected into a lump at the printing start side on the screen 82.

Then, in the printing process following the scraping process, as shown in FIG. 9, the screen 82 and the printing table 81 are moved toward each other, whereby the screen 82 is overlaid on the printing table 81. At this time, the squeegee 84 and the scraper 83 are switched in their positional relation relative to the screen 82. That is, during the printing process, the squeegee 84 is in lightly urging contact with the screen 82, whereas the scraper 83 is kept from contact with the screen 82. In this state, the squeegee 84 and the scraper 83 are moved horizontally from the printing start side to the printing end side, whereby the lump of the ink 85 is spread out over the screen 82 by the squeegee 84 and the spread ink 85 adheres to a printing material 86 through non-masking portions of the screen 82 to print the printing material.

When the printing is carried out as described above, conventionally, parallelism of the squeegee to the screen is adjusted before starting printing work. In case this adjustment of parallelism is not properly carried out, there occurs low printing pressure on one side of the squeegee, causing a blurred print, i.e. faulty printing. Further, conventionally, it is impossible to adjust printing pressure during a printing operation. Therefore, whenever such a faulty printing occurs, the printing is required to be stopped to adjust the parallelism between the squeegee and the screen, resulting in a degraded manufacturing efficiency or productivity.

SUMMARY OF THE INVENTION

The invention has been made with a view to solving the above problems, and it is an object of the invention to provide a screen printing apparatus which is capable of adjusting parallelism of a squeegee to a screen even during printing to effect coating with a uniform coating thickness, and is capable of printing and coating high-density fine-line patterns.

To attain the above object, according to a first invention, there is provided a screen printing apparatus comprising a squeegee arranged above a screen in a manner opposed to the screen, the squeegee being supported such that the squeegee is movable in a vertical direction and at the same time movable in a direction of printing of a printing material; a plurality of urging means (or pressing means) arranged on a supporting frame supporting the squeegee in a manner suspended therefrom, for urging the squeegee toward the screen; urging force-detecting means for detecting urging forces of the urging means during movement of the squeegee for printing; and first control means for controlling the urging means based on results of detection by the urging force-detecting means to adjust urging forces applied by the urging means to the squeegee.

According to a second invention, there is provided a screen printing apparatus according to the first invention, including a print head frame supporting the supporting frame and having vertical driving means for driving the supporting frame in a vertical direction, the print head frame being movable in a direction of printing in a reciprocating manner; floating support means arranged on the supporting frame for supporting the squeegee in a floating state relative to the supporting frame; second control means for controlling driving of the urging means to thereby set actual printing pressure acting on the squeegee to 0 when the squeegee has been moved by way of the supporting frame to be brought into contact with the screen by the vertical driving means; and urging force-setting means for setting urging forces which are to be applied to the squeegee by way of the urging means after the actual printing pressure acting on the squeegee is adjusted to assume 0 by the second control means; wherein the first control means controls the urging means in a manner such that values of the urging forces detected by the urging force-detecting means are balanced.

Therefore, according to the first invention, the urging force-detecting means detects the urging forces of urging means during movement of the squeeze for printing. Further, during the same movement for printing, the first control means adjusts the urging forces applied to the squeegee by the urging means based on results of detection by the urging force-detecting means.

According to the second invention, the floating support means supports the squeegee in a floating state relative to the supporting frame. In this state, before starting printing, the second control means drives the urging means to thereby set the actual printing pressure acting on the squeegee to 0 when the squeegee has been moved by way of the supporting frame to be brought into contact with the screen.

The urging force-setting means sets urging forces which are to be applied to the squeegee by way of the urging means after the actual printing pressure applied to the squeegee is adjusted to assume 0 by the second control means. The first control means controls the urging means such that values of the urging forces detected by the urging force-detecting means are balanced during the printing.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENT

The invention will now be described in detail with reference to FIGS. 1 to 7 illustrating a screen printing apparatus according to an embodiment thereof.

Figure 2:
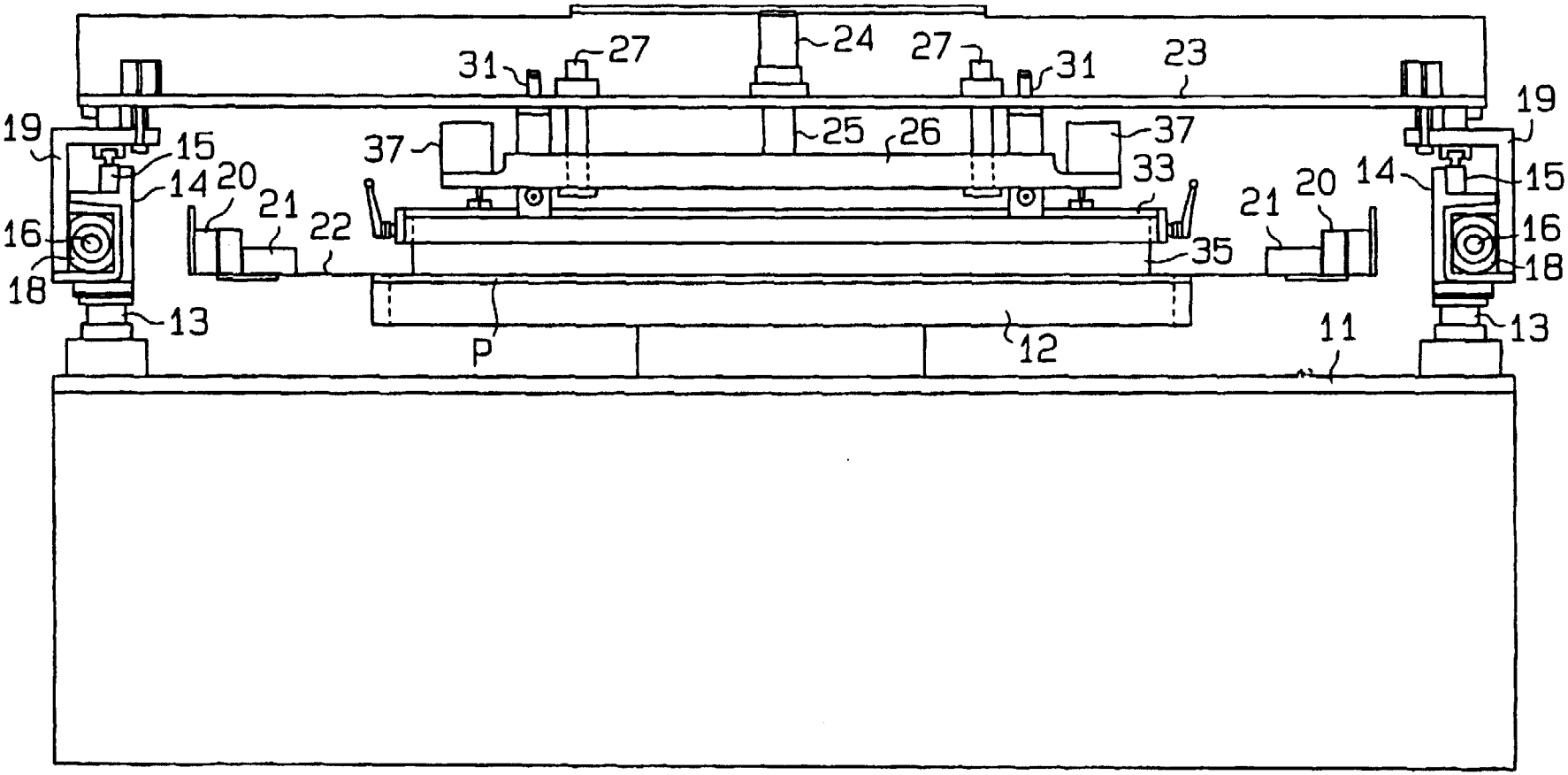
FIG. 2 is a schematic side view showing the whole arrangement of the screen printing apparatus.

FIG. 2 schematically shows the whole arrangement of the screen printing apparatus. As shown in the figure, an X-Y-q table 12 is arranged above a main body 11 for having a printing material P placed thereon in a manner unmovable during printing. The X-Y-q table 12 is formed with a plurality of holes (not shown) opening in the top thereof for holding the printing material P placed thereon by vacuum. The X-Y-q table 12 is operatively connected to a driving system (not shown) within the main body 11 via a gear mechanism or the like (not shown) such that it can be moved in the directions of an X axis and a Y axis and at the same time it can be rotated.

There are four columns 13 erected at respective four corners on the top of the main body 11 in a manner corresponding to the X-Y-q table 12. Spanned between pairs of columns 13 each aligned in a carrying direction (in a direction perpendicular to the sheet surface of FIG. 2), are a pair of rail supporting frames 14 on which carrying rails 15 are fixed, respectively. Further, the columns 13 are operatively connected to a motor (not shown) as a driving force source via a lifting/lowering mechanism (not shown) arranged in the main body 11 whereby the columns 13 are elevated (moved upward) or lowered (moved downward) by normal or reverse rotation driving of the motor.

In each of the rail supporting frames 14, there is supported a ball screw 16 extending in a carrying direction. The ball screws 16 are operatively connected to a carrying drive motor 17, appearing in FIG. 4. Screwed on the ball screws 16 are nuts 18 to which carrier frames 19 are fixed. Each carrier frame 19 has an upper portion slidably fitted on the carrying rails 15 such that the carrier frame 19 can slide in the carrying direction. The nuts 18 are moved along the carrying rails 15 in a horizontal direction by rotation of the carrying drive motor 17 according to printing conditions, thereby moving the carrier frames 19 in the same direction.

As shown in FIG. 2, a rectangular printing frame 20 is arranged on the table 12. The printing frame 20 is mounted on the rail supporting frames 14. (In FIG. 2, a linkage between the rail supporting frames 14 and the printing frame 20 is omitted for the convenience of explanation).

A screen frame 21 having a rectangular shape larger than the table 12 is supported on a bottom side of the printing frame 20, and a screen 22 masked in a predetermined manner is spread on a bottom of the screen frame 21. On a surface of the screen 22, there is formed a coating of an emulsion. The screen 22 is moved toward or away from the table 12 as the printing frame 20 is lowered or elevated.

Figure 1:
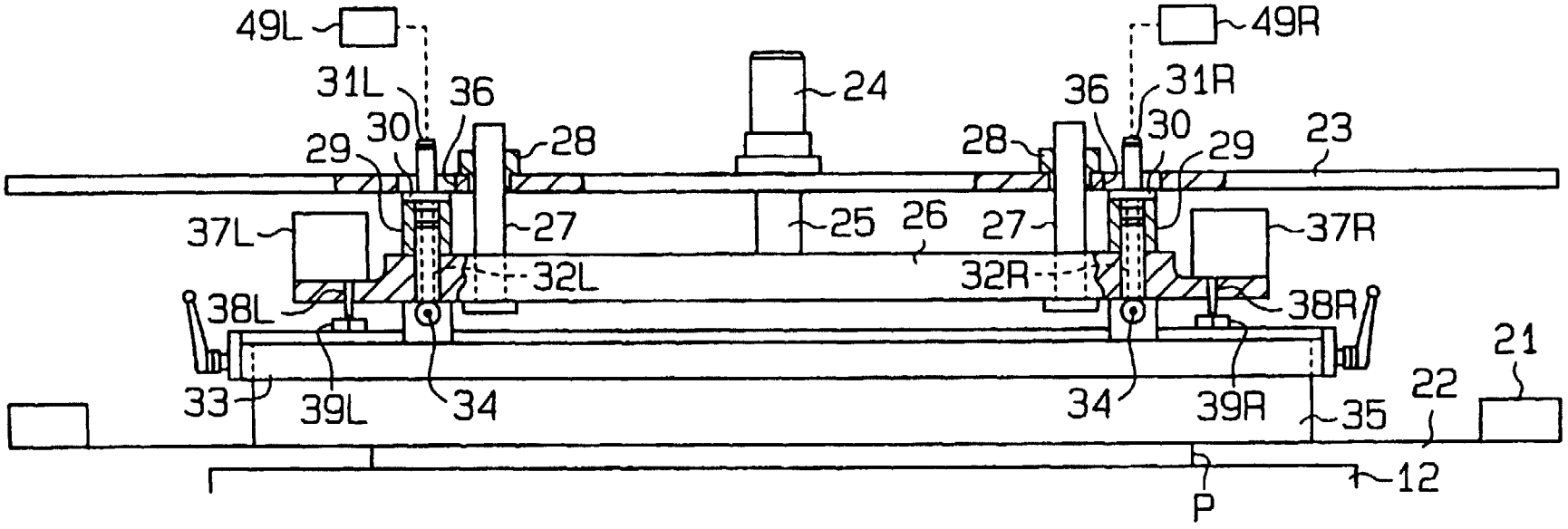
FIG. 1 is a side view showing a pertinent portion of a screen printing apparatus according to the present embodiment of the invention.

As shown in FIG. 2, a bracket 23 which forms a print head frame is spanned between the tops of the carrier frames 19. As shown in FIG. 1, in a central portion of the bracket 23, an AC servo motor 24 as vertical driving means is fixedly arranged on a printing start side. The AC servo motor 24 has an output shaft 25 extending through the bracket 23. A squeegee-supporting part 26 in a longitudinally-extending state as a supporting frame has a central portion fixed to the output shaft 25 of the AC servo motor 24 such that the squeegee-supporting part 26 is elevated or lowered by normal or reverse rotation driving of the AC servo motor 24. Guide shafts 27 extend upward from respective opposite ends of the squeegee-supporting part 26 with upper ends thereof extending through the bracket 23 in a manner slidable in respective guide cylinders 28 provided on the bracket 23.

At locations outward of the guide shafts 27, a pair of fitting cylinders 29 are fixedly arranged on the squeegee-supporting part 26, with air float cylinders 31 as floating support means rigidly fitted on upper ends thereof via fitting plates 30. Cylinder rods 32 of the air float cylinders 31 extend downward through respective ones of the fitting cylinders 29 and the squeegee-supporting part 26. A squeegee holder 33 has opposite ends thereof pivotally movably supported by lower ends of the cylinder rods 32 by way of respective shafts 34. A squeegee 35 is secured to the bottom of the squeegee holder 33.

The above-mentioned pair of air float cylinders 31 each have air pressure applied thereto by an air compressor (not shown) and scraper control valves 49R and 49L (see FIG. 1) each formed by a high precision regulator controls driving thereof. The air float cylinders 31 are each in a floating state when the same hold the squeegee holder 33 and the squeegee 35 in respective lifted positions. When the squeegee holder 33 is urged by pressure motors 37, referred to hereinafter, air within the cylinders is permitted to expand so that the squeegee holder 33 can be lowered.

When the screen printing apparatus is initialized for printing, the air float cylinders 31 expand or contract their cylinder rods 32 separately from each other. Further, the bracket 23 is formed with through holes 36, at locations corresponding to the air float cylinders 31, to thereby prevent the bracket 23 from interfering with the air float cylinders 31 when the squeegee-supporting part 26 is elevated.

On the other hand, at locations outward of the fitting cylinders 29, the pressure motors 37 as urging means are mounted in pair on the squeegee-supporting part 26. Each pressure motor 37 is a linear motor having an output shaft 38 that reciprocates in response to an electric signal supplied to the linear motor. Each output shaft 38 passes through the squeegee-supporting part 26 and projects downward therefrom. The output shafts 38 are elevated or lowered by reciprocal movement of the output shafts 38 of the pressure motors 37.

A motor having a general rotary shaft can be replaced with the pressure motor. In this case, a mechanism is required for converting rotation of the rotary shaft to reciprocal movement of the output shaft.

The pressure motors 37 have position sensors SR and SL respectively arranged therein each of which is comprised of an linear encoder for detecting a displacement position of the output shaft 38.

Further, in a manner corresponding to the output shafts 38 of the pressure motors 37, pressure sensors 39 as urging force-detecting means are fixedly arranged on the top of the squeegee holder 33 at opposite ends thereof for being brought into contact with the output shafts 38, respectively.

Next, an arrangement for supporting a scraper 44 will be described with reference to FIG. 3. This arrangement, however, is basically similar to that for supporting the squeegee 35, and hence description of component parts identical or corresponding to those of the squeegee 35 will be omitted, while the component parts corresponding to those of the squeegee 35 will be designated by reference numerals each obtained by adding one hundred to a reference numeral of a corresponding one of the component parts of the squeegee 35.

Figure 3:
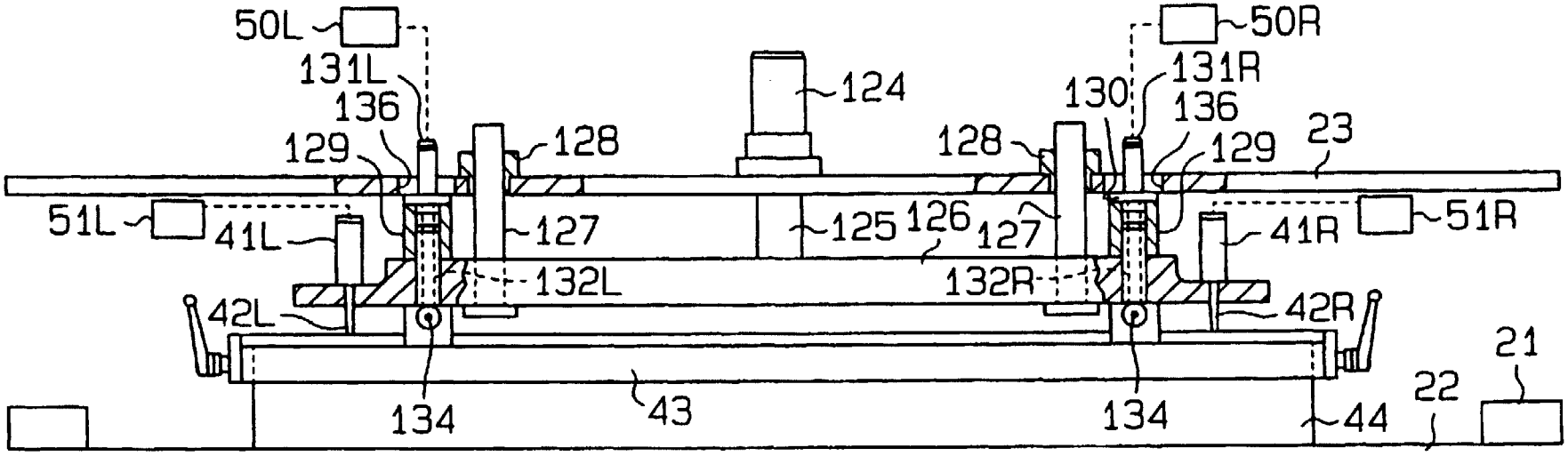
FIG. 3 is a side view showing a pertinent portion of the screen printing apparatus.

As shown in FIG. 3, the scraper 44 is suspended from a central portion of the bracket 23 on a printing end side. In the arrangement for supporting the scraper 44, a pair of air cylinders 41 are mounted on a scraper-supporting part 126 in place of the pressure motors 37, with cylinder rods 42 thereof freely extending through the scraper-supporting part 126, for having the tips thereof brought into contact with the top of a scraper holder 43 which holds the scraper 44.

The pair of air cylinders 41 each have air pressure applied thereto by an air compressor (not shown) and second scraper control valves 51R and 51L (see FIG. 3) each comprised of a high precision regulator, referred to hereinafter, controls driving of each air cylinder. Further, air passages (not shown) used for applying air pressure to the air cylinders 41 each have an air pressure sensor 47 arranged therein for detecting air pressure applied to the air cylinders 41.

A pair of air float cylinders 131 each have air pressure applied thereto by an air compressor (not shown) and first scraper control valves 50R and 50L (see FIG. 3) each comprised of a high precision regulator controls driving thereof.

The AC servo motors 24 and 124 each elevate and lower the output shafts 25 and 125, respectively, separately from each other according to printing conditions.

That is, in the printing process, the output shaft 25 of the AC servo motor 24 lowers to urge the squeegee 35 in such a direction as will bring the same into lightly urging contact with the screen 22, whereas the output shaft 125 of the AC servo motor 124 for the scraper elevates to hold the scraper 44 at a position away from the screen 22. On the other hand, in the scraping process after the printing has been carried out, the output shaft 125 of the AC servo motor 124 for the scraper lowers to urge the scraper 44 in such a direction as will bring the same into lightly urging contact with the screen 22, whereas the output shaft 25 of the AC servo motor 24 elevates to hold the squeegee 35 at a position away from the screen 22.

Next, an electrical circuit of the screen printing apparatus according to the present embodiment will be described with reference to FIG. 4.

Figure 4:
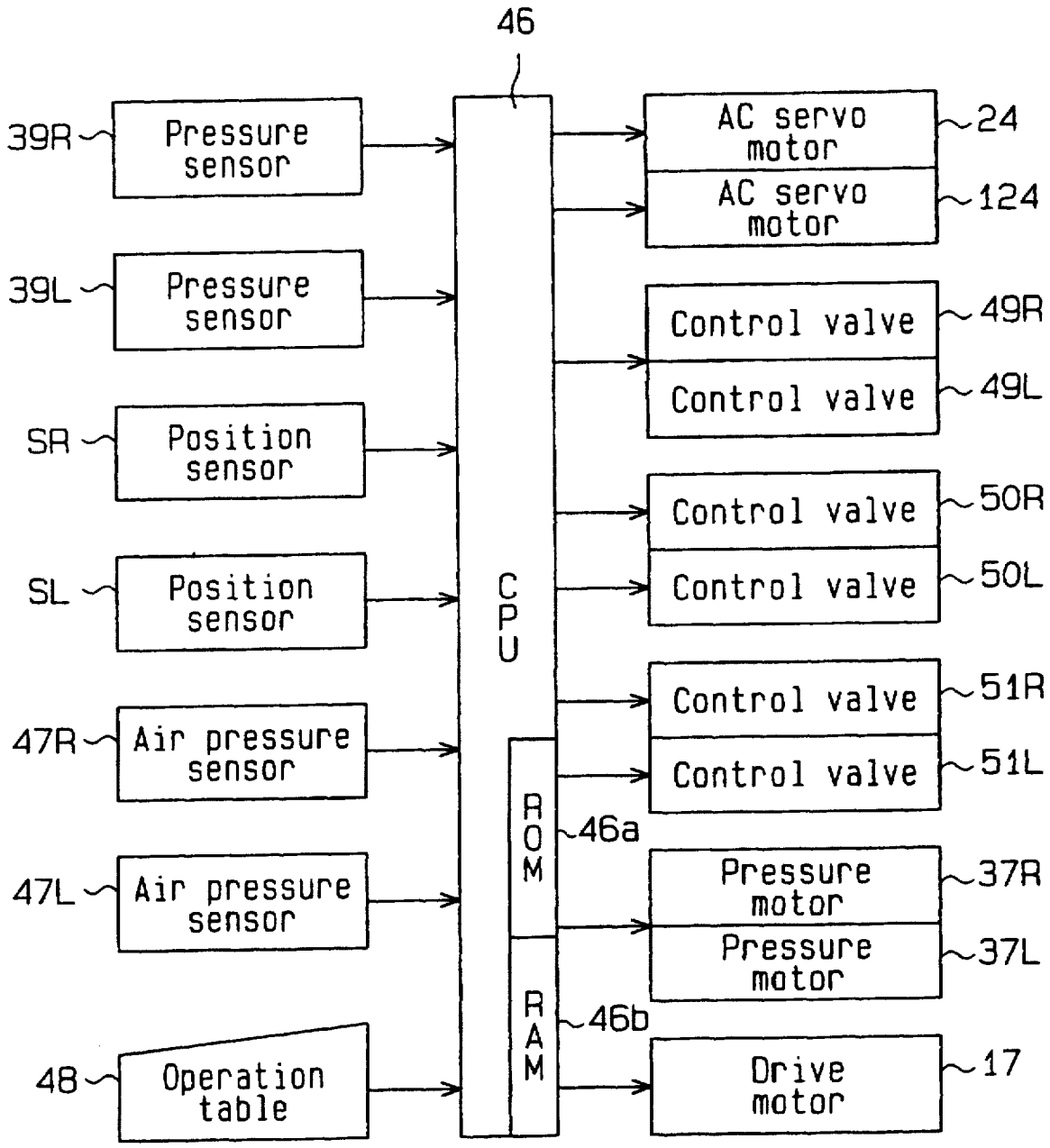
FIG. 4 is a block diagram of an electric circuit showing an electrical construction of the screen printing apparatus.

FIG. 4 is a block diagram showing the electrical circuit of the screen printing apparatus. It should be noted that in FIGS. 1 to 3, R is added to each reference numeral of component parts related to urging, position control or the like of the squeegee 35 or the scraper 44 on the right side of the AC servo motors 24 and 124 located in the center, while L is added to each reference numeral of component parts related to urging, position control or the like of the squeegee 35 or the scraper 44 on the left side of the same.

A central processing unit (hereinafter referred to as "the CPU") 46 functioning as a control section is comprised of a ROM **46*a* which stores various control programs, and a RAM 46*b* as readable and writable memory means for storing various input and output data and operation results. The CPU 46** forms a first control device and a second control device.

The pressure sensors 39R and 39L are connected to the CPU 46 for supplying the CPU 46 with pressure signals indicative of urging forces which act thereon when the sensors are in contact with the output shafts 38R and 38L of the pressure motors 37R and 37L. The position sensors SR and SL are connected to the CPU 46 for supplying the CPU 46 with position signals indicative of displacement positions of the output shafts 38R and 38L of the pressure motors 37R and 37L. The air pressure sensors 47R and 47L are connected to the CPU 46 for supplying the CPU 46 with respective pressure signals indicative of air pressures applied to the air cylinders 41R and 41L. An operation table 48 forming urging force-setting means is provided with input keys such as ten keys and the like and connected to the CPU 46. The CPU 46 stores squeegee urging force-setting data and scraper-setting pressure entered by ten keys in a predetermined memory area within the RAM **46*b***.

The AC servo motors 24 and 124 are connected to the CPU 46 for normal or reverse rotation driving in response to respective drive control signals from the CPU 46. The control valves 49R, 49L, 50R, 50L, 51R and 51L are connected to the CPU 46 for being switched over in respect of their operative states according to switch-over control signals from the CPU 46 to elevate or lower or hold the air float cylinders 31R, 31L, 131R and 131L and the cylinder rods 32R, 32L, 131R, 131L, 41R and 41L of the air cylinders 41R and 41L.

The pressure motors 37R and 37L are connected to the CPU 46 for elevating or lowering the output shafts 38 in response to pressure control signals from the CPU 46.

The carrying drive motor 17 for carrying the bracket 23 forming a print head frame is connected to the CPU 46 for normal or reverse rotation driving in response to drive signals from the CPU 46 to carry the bracket 23. Now, operation of the screen printing apparatus constructed as above will be described. First, the squeegee 35 and the scraper 44 are mounted on the squeegee holder 33 and the scraper holder 43, respectively. A printing material P is placed in a 12 predetermined position on the X-Y-q table 12, and the screen 22 is arranged at an identical distance from the printing material P as it is arranged when printing is actually carried out.

Next, an actual printing pressure applied by the squeegee and a scraper pressure are set by the use of ten keys on the operation table 48 and the data of the actual printing pressure and the scraper set pressure are stored in respective predetermined regions within the RAM 46b of the CPU 46. The bracket 23 forming the print head frame is in its scraping start position (hereinafter referred to as its "original position"). The tips of the output shafts 38R and 38L of the pressure motors 37R and 37L are in respective original positions. In this state, the output shafts 38R and 38L are not in contact with the pressure sensors 39R and 39L.

Figure 5:
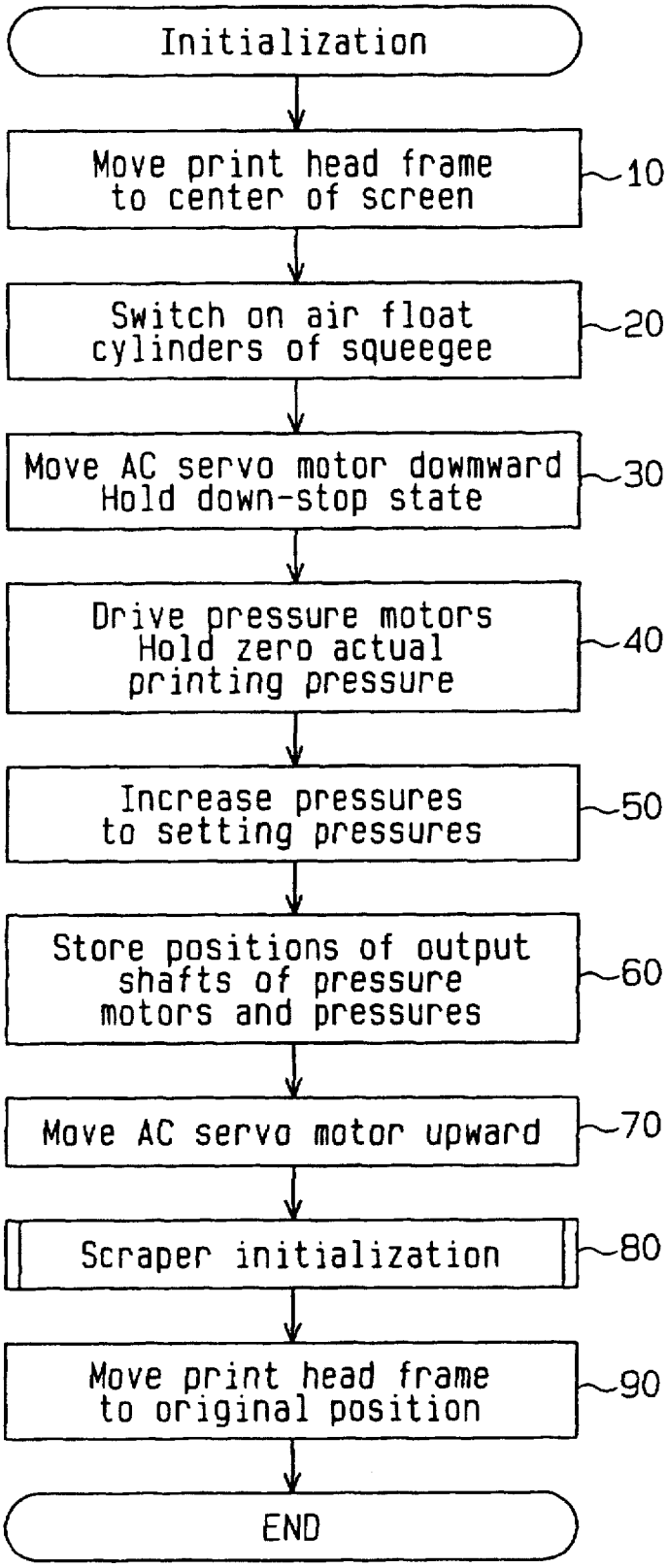
FIG. 5 is a flow chart showing a routine for initialization carried out by a CPU.

In this state, first, initialization of the screen printing apparatus is executed. FIG. 5 shows a control routine carried out by the CPU 46 when the scraper is initialized.

When the program starts this control routine, a drive signal is supplied to the carrying drive motor 17 in step 10, and drive control is executed to thereby move the print head frame (the bracket 23) to a center of the screen 22. Then, in step 20, control signals are supplied to the control valves 49R and 49L to thereby switch on the control valves 49R and 49L, whereby air pressure is applied to the air float cylinders 31R and 31L by a compressor (not shown) to put the air float cylinders 31R and 31L into operation. As the air float cylinders 31R and 31L are put into operation, the squeegee 35 is elevated or lifted by a predetermined distance by way of the squeegee holder 33. Thus, the squeegee holder 33 is held in a floating state at this time. When the squeegee holder 33 is in the floating state, the output shafts 38R and 38L of the pressure motors 37L and 37R are in contact with the pressure sensors 39R and 39L.

Next, in step 30, a drive control signal is supplied to the AC servo motor 24 to start the same, whereby the squeegee-supporting part 26, the squeegee holder 33 and the squeegee 35 per se are lowered. When the squeegee 35 comes into contact with the screen 22, tension of the screen 22 elevates the squeegee 35 and the squeegee holder 33 and the pressure sensors 39R and 39L are relatively moved to be brought into contact with the output shafts 38R and 38L of the pressure motors 37 to detect respective pressures acting thereon. The pressure sensors 38R and 38L deliver signals indicative of detected pressures to the CPU 46. Based on these signals, the cPU 46 stops driving of the AC servo motor 24 to hold the squeegee 35 in contact with the screen 22 (hereinafter this state is referred to as "the down-stop state").

Then, in step 40, pressure control signals are supplied to the pressure motors 37R and 37L to drive the same, whereby the output shafts 38R and 38L are simultaneously lowered. As the output shafts 38R and 38L lower, they urge the squeegee holder 33 via the pressure sensors 39R and 39L, whereby the squeegee 35 is brought into contact with the printing material P against the tension of the screen 22. This state where the squeegee 35 is in contact with the printing material P against the tension of the screen 22 is different from the state in which the output shafts 38R and 38L are in contact with the screen 22 alone by way of the squeegee holder 33 and the squeegee 35 so that the detected pressure changes sharply. Therefore, to maintain this state of the squeegee in which the pressure has sharply changed as a zero actual printing pressure state, the driving of the pressure motors 37R and 37L is stopped to hold the output shafts 38R and 38L in the present positions, respectively. Next, in step 50, the squeegee urging force-setting data are read from the RAM **46*b* and then based on this setting data (setting values), pressure control signals are further supplied to the pressure motors 37R and 37L in the zero actual printing pressure state. Consequently, the output shafts 38R and 38L of the pressure motors 37R and 37L, further urge the pressure sensors 39R and 39L, so that the squeegee 35 is urged downward and at the same time the pressure signals from the pressure sensors 39R and 39L are supplied to the CPU 46. The CPU 46, while monitoring these pressure signals, continues to drive the pressure motors 37R and 37L until the pressure values indicated by the pressure signals become equal to the above-mentioned setting values. During setting of the actual printing pressure, the values of the pressures detected by the pressure sensors 39R and 39L are displayed on the operation table 48** in digital form.

Next, in step 60, when the pressure values detected by the pressure sensors 39R and 39L become equal to the setting values, the pressure values and the displacement positions of the output shafts 38R and 38L are stored in respective predetermined regions within the RAM **46*b***.

In the following step 70, the CPU 46 rotates the AC servo motor 24 in a reverse direction by supplying the drive control signal thereto, to thereby elevate the squeegee 35 to the position assumed before it starts to be lowered in step 30, and then the program proceeds to step 80 wherein "scraper initialization" is carried out.

Figure 6:
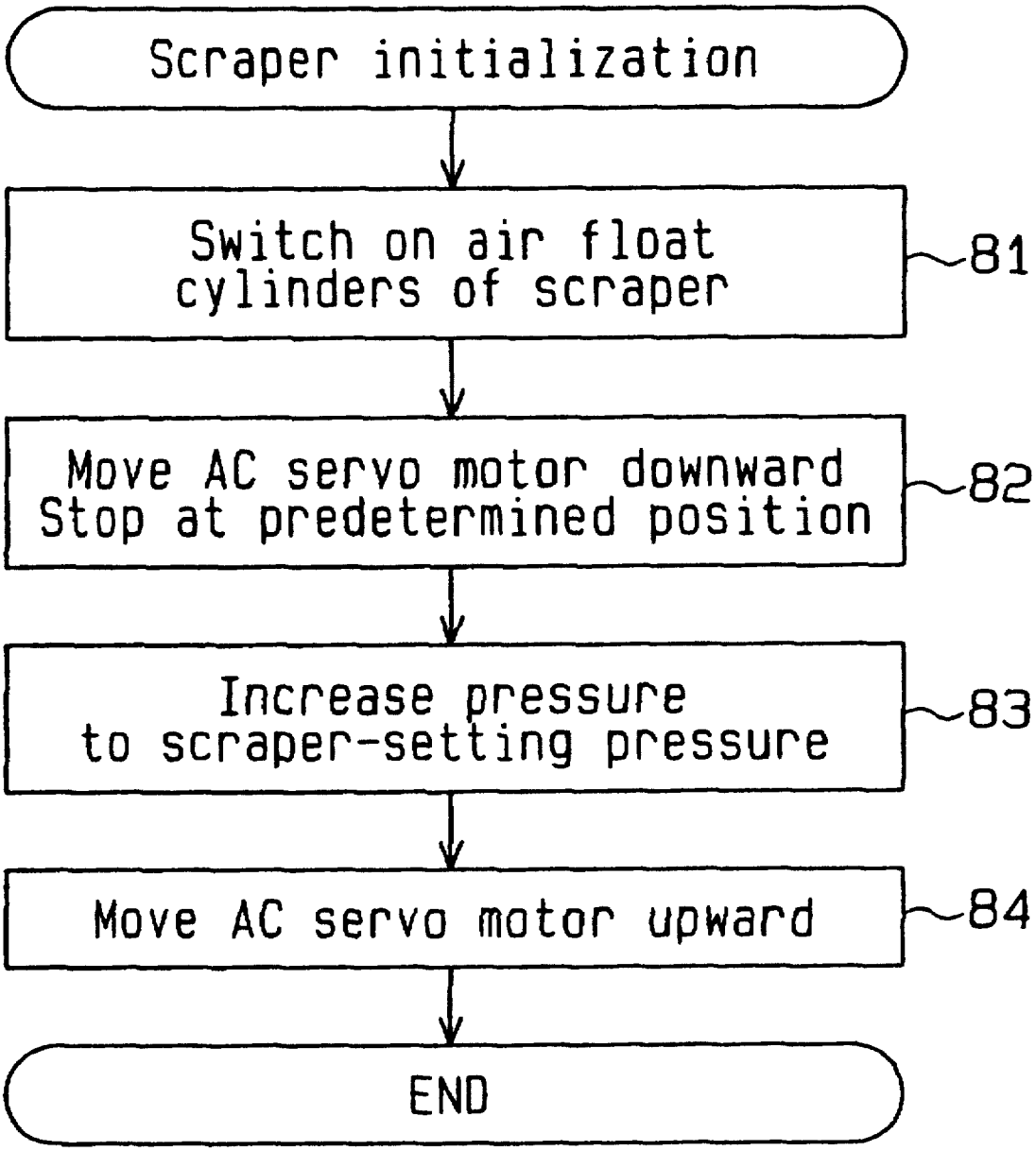
FIG. 6 is a flow chart showing a routine for scraper initialization carried out by the CPU.

Now, a routine for "scraper initialization" will be described in detail with reference to FIG. 6.

When the program starts this routine, first in step 81, the control signals are supplied to the control valves 50R and 50L to switch them on, whereby air pressure supplied from a compressor (not shown) is applied to the air float cylinders 131R and 131L, to put them into operation. As the air float cylinders 131R and 131L are in operation, the scraper 44 is elevated or lifted up by a predetermined distance by way of the scraper holder 43. Therefore, in this state, the scraper holder 43 is held in a floating state.

Next, in step 82, the drive control signal is supplied to the AC servo motor 124 to drive the AC servo motor 124, whereby the scraper-supporting part 126 is lowered to a predetermined position. This predetermined position is set in advance to a position where the scraper 44 lowered together with the scraper-supporting part 126 comes into contact with screen 22. When the scraper 44 is lowered to this predetermined position where the scraper 44 is in contact with the screen 22, the AC servo motor 124 is stopped. This stoppage of driving of the AC servo motor 124 is effected based on results of the detection by a position sensor comprised of an encoder (not shown) which is arranged within the AC servo motor 124 so as to detect whether or not the scraper-supporting part 126 is in the predetermined position.

In the following step 83, data of the scraper-setting pressure are read from the RAM **46*b*, and based on the read data, the control signals are supplied to the control valves 51R and 51L to thereby switch on the control valves 51R and 51L. Then, air pressure from a compressor (not shown) is applied to the air float cylinders 41R and 41L to thereby operate the air float cylinders 41R and 41L. As these air float cylinders 41R and 41L are operated, the cylinder rods 42R and 42L thereof are simultaneously lowered together to urge the scraper holder 43**.

As the scraper holder 43 is urged downward, the scraper 44 is placed into a position where the scraper 44 is in lightly urging contact with the screen 22.

Then, in step 84, the CPU 46 supplies the drive control signal to the AC servo motor 124 for reverse rotation of the same to thereby elevate the scraper 44 to the position assumed before it started to be lowered in step 82, followed by terminating this routine. When the "scraper initialization" routine in step 80 is thus terminated, the program proceeds to step 90, where a carrier drive signal is supplied to the carrying drive motor 17 for reverse rotation thereof to return the supporting frame 23 as the print head frame to its original position, followed by terminating the initialization routine.

Figure 7:
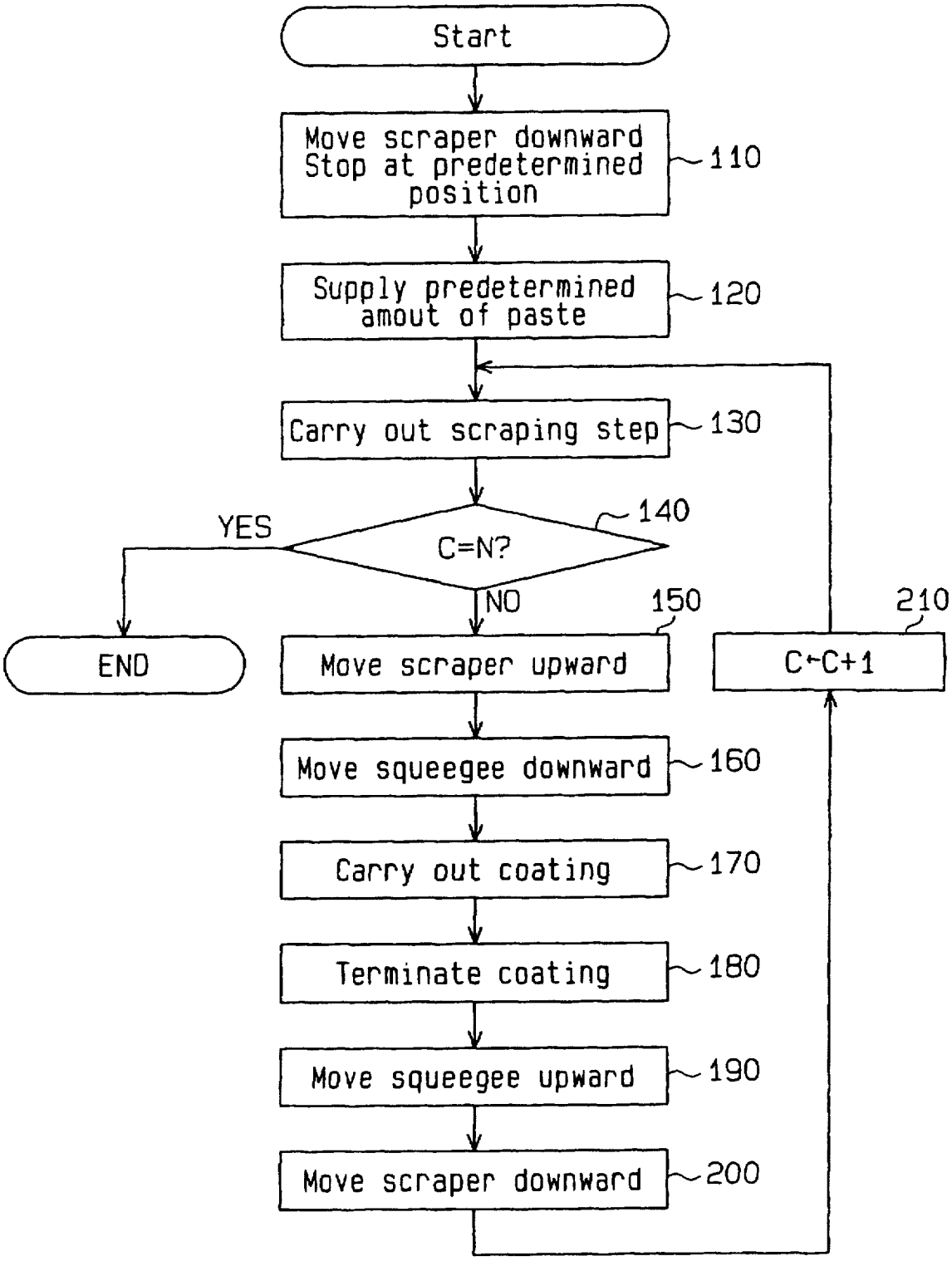
FIG. 7 is a flow chart showing a routine for print control carried out by the CPU.
Figure 8:
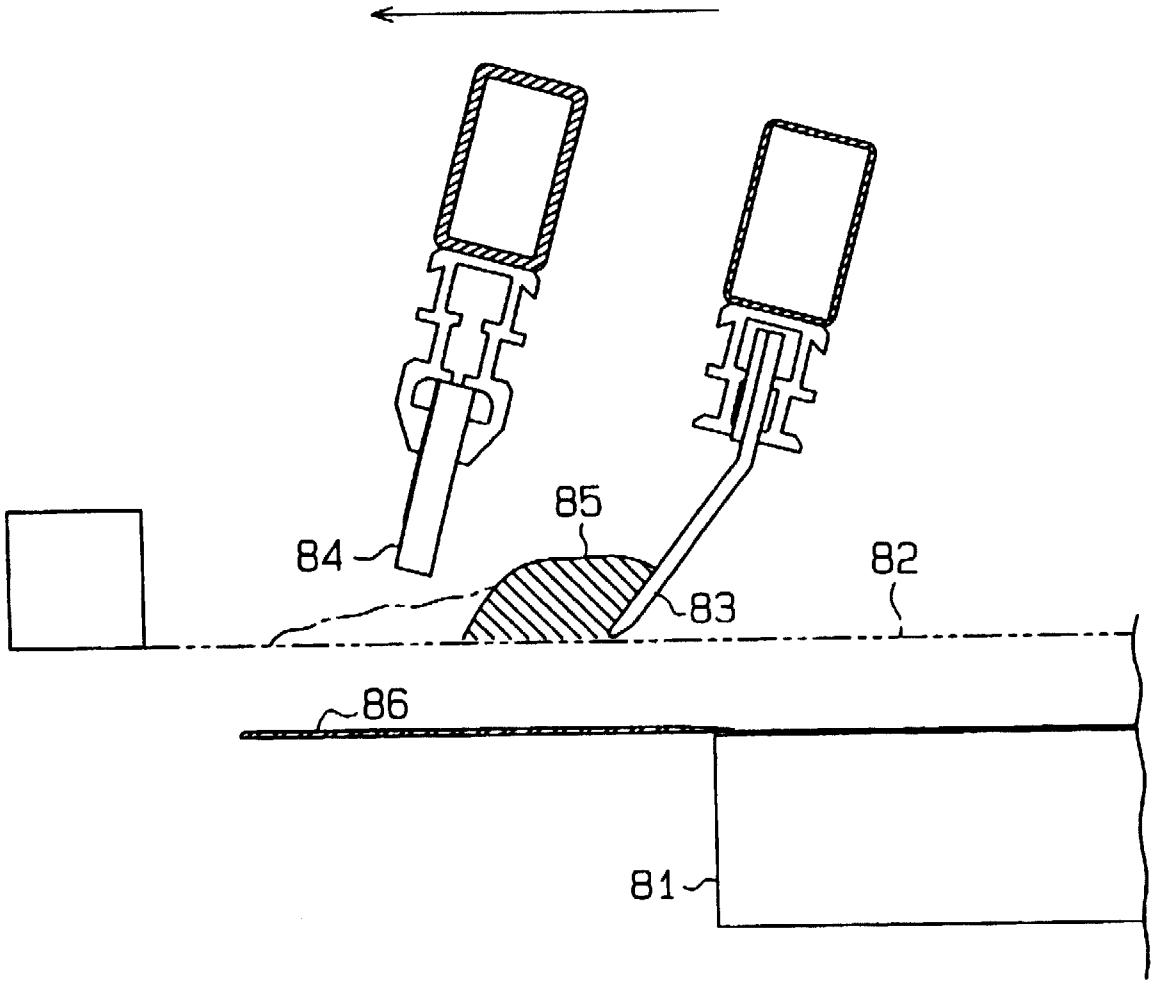
Fig.8 ( Prior Art)
FIG. 8 is a diagram explaining a conventional manner of switching from scraping process to printing process.
Figure 9:
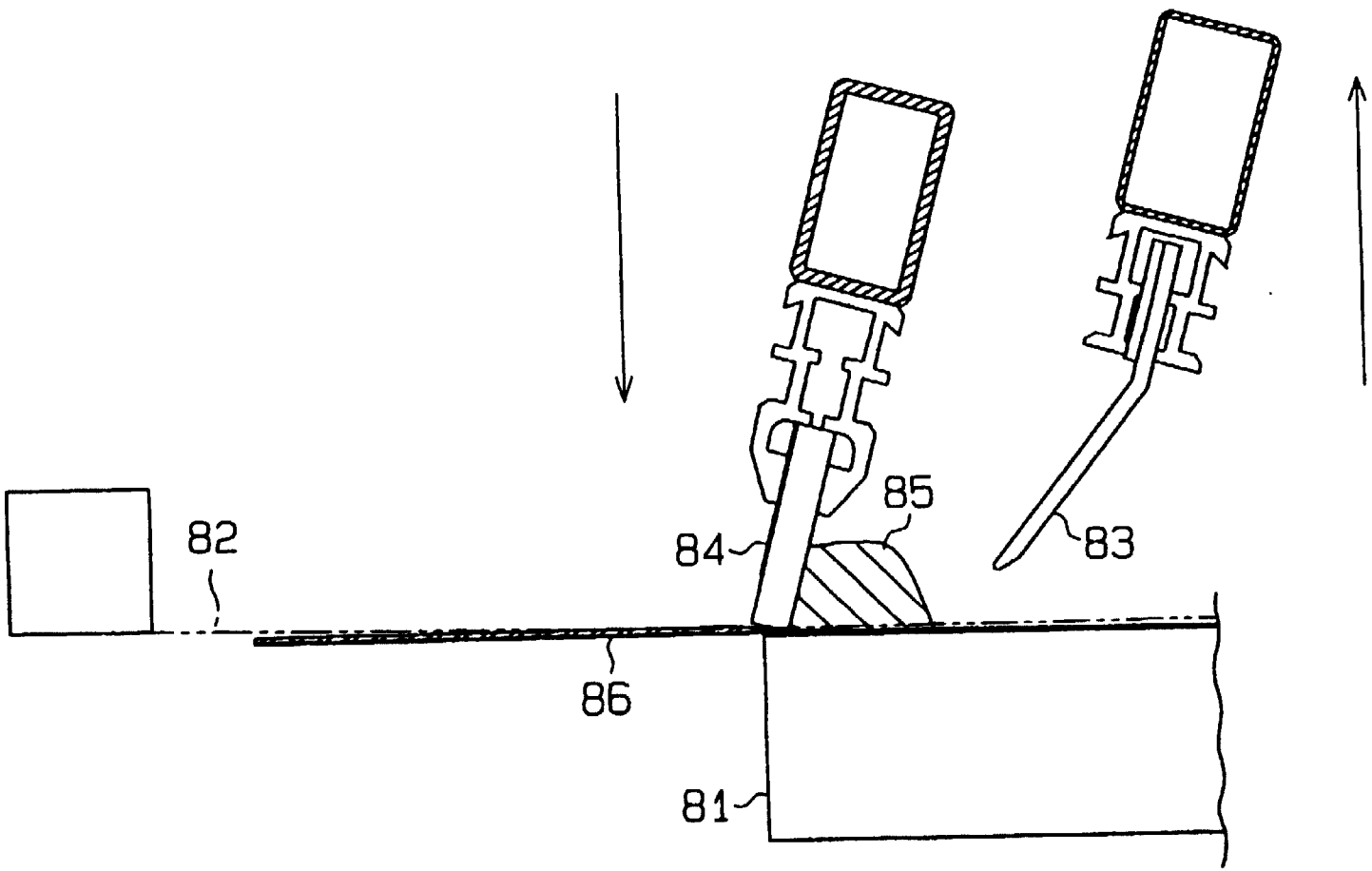
Fig.9 ( Prior Art)
FIG. 9 is a diagram explaining an early stage of the conventional printing process.

Now, description will be made of a print control routine executed subsequent to the initialization routine described above. FIG. 7 shows the print control routine executed by the CPU 46. It should be noted that in this routine, the air cylinders 41R and 41L and the air float cylinders 31R, 31L, 131R and 131L are respectively in operation, i.e. in an ON state. Therefore, the squeegee 35 and the scraper 44 are in respective floating states by the operations of the air float cylinders 31R, 31L, 131R and 131L.

When this routine is started, in step 110, the drive control signal is supplied to the AC servo motor 124 in the original position (scraping start position) to drive the AC servo motor 124 such that the scraper-supporting part 126 is lowered to the predetermined position. When the scraper-supporting part 126 is lowered to the predetermined position, the scraper 44 is brought into urging contact with the screen 22 with the scraper-setting pressure. Then, in step 120, the CPU 46 drives a paste (ink) supply device (not shown) to supply a predetermined amount of paste on the screen 22.

In the following step 130, the CPU 46 carries out the scraping step. In the scraping step, a motor (not shown) is driven to thereby elevate the lifting/lowering mechanism, whereby the screen 22 is moved away from the table 12.

Then, the CPU 46 drives the carrying drive motor 17 to cause the scraper 44 to slide on the screen 22 from the original position to the printing start side, whereby paste is scraped together into a lump at the printing start side of the screen 22.

After the scraping step, if a printing material P is on the table 12, the printing material P is carried away from the table 12 and a next printing material P is carried in onto the table 12 to be held on the top of the table 12 by vacuum. Then, the screen 22 is moved closer to the table 12 by the lifting/lowering mechanism to be overlaid on the table 12.

When the screen 22 is overlaid on the table 12 as described above, the program proceeds to the following step 140, wherein the CPU 46 reads in the count of a print counter C and determines whether or not the count of the printing counter C indicative of the number of printings carried out has reached a predetermined number N. The number of printings has been stored in advance in a predetermined region within the RAM **46*b* by operating ten keys and the like on the operation table 48. When this step is first carried out, the count of the print counter C has been reset to 0, so that the answer to this question becomes negative (NO), and then the program proceeds to step 150**.

In step 150, the CPU 46 supplies the drive control signal to the AC servo motor 124 to thereby rotate the same in a reverse direction and elevates the scraper 44 to the position assumed before it started to be lowered in step 110. In the following step 160, the CPU 46 supplies the drive control signal to the AC servo motor 24 to thereby drive the same such that the squeegee-supporting part 26, the squeegee holder 33 and the squeegee 35 are lowered to respective positions assumed in the down-stop state similarly to step 30. Then, the CPU 46 drives the pressure motors 37R and 37L, to thereby apply pressure to the squeegee 35 such that the detected pressure values become equal to the pressure values (setting values) stored in the RAM **46*b* in step 60 and the detected displacement positions of the output shafts 38R and 38L become equal to those stored in the RAM 46*b*** in the same step.

As described above, in steps 150 and 160, the positional relationship between the squeegee 35 and the scraper 44 relative to the screen 22 is switched over by driving the AC servo motors 24 and 124, etc.

Then, the program proceeds to step 170, wherein the CPU 46 drives the carrying drive motor 17 such that the ball screw 16 is rotated in a direction reverse to that of the rotation of the ball screw 16 assumed in the scraping step. According to the rotation of the ball screw 16, the bracket 23 is horizontally moved from the printing start side to the original position (scraping start position) side, i.e. in the direction of printing of a printing material P. As the bracket 23 is moved in this direction, the squeegee 35 is moved from the printing start side to the original position (scraping start position) side. The squeegee 35, which has been lowered to the printing start position, slides on the screen 22 toward the original position (scraping start position) in this vertical position while spreading the lump of paste on the screen 22. The spread paste adheres to a printing material P on the table 12 through non-masking portions of the screen 22 whereby printing is effected on the screen printing material.

During this printing step, when the parallelism of the squeegee 35 to the screen 22 is impaired to make the reactionary forces acting on the left side and the right side of the squeegee 35 different from each other, pressure (urging force) values detected by the pressure sensors 39R and 39L in contact with the output shafts 38R and 38L of the pressure motors 37R and 37L are also different from each other. In such an event, the CPU 46 drives the pressure motors 37R and 37L to elevate or lower the output shafts 38R and 38L of the pressure motors 37R and 37L such that the differences between the actual values and the setting values stored in the RAM **46*b* are reduced to zero to thereby change the urging forces acting on the squeegee 35. As a result, even if reactionary forces from the screen 22 detected at the right side and the left side of the squeegee 35 are different from each other during the printing step, the squeegee 35 is controlled by driving the pressure motors 37** to execute the printing with appropriate urging forces.

Then, in step 180, the printing step is terminated, and the scraping step is started by driving the AC servo motors 24 and 124 in the following steps 190 and 200. More specifically, in step 190, the AC servo motor 24 is elevated, whereas in step 200, the AC servo motor 124 is lowered again similarly to step 110. Then, in step 210, the print counter C is incremented and the program proceeds to step 130 wherein the scraping step is carried out.

More specifically, the scraper 44 is brought into lightly urging contact with the screen 22, while the squeegee 35 is elevated to be out of contact with the screen 22. Then, as the ball screw 16 rotates, the bracket 23 is horizontally moved from the original position to the printing start side. The scraper 44 slides on the screen 22 to scrape paste remaining on the masking portion of the screen 22 and returns to its original position.

When the loop from step 130 to step 210 is executed predetermined number of times and the count of the print counter C reaches a predetermined value in step 150, the answer to the question of step 140 becomes affirmative (YES), followed by terminating the present print control routine.

The following advantageous effects can be obtained by the screen printing apparatus according to the present embodiment.

(1) In the present embodiment, during the printing step, if the parallelism of the squeegee 35 to the screen 22 is impaired to make reactionary forces acting on the left side and the right side of the squeegee 35 different from each other, the CPU 46 drives the pressure motors 37R and 37L to move the output shafts 38R and 38L thereof such that the actual pressure values become equal to the setting pressure values stored in the RAM 46b, to thereby change the urging forces acting on the squeegee 35. That is, if a detected pressure value is lower than a setting pressure value, the CPU 46 drives a corresponding one of the pressure motors in a pressure-increasing direction to thereby elevate a corresponding one of the output shafts, whereas if the detected value is higher than the setting pressure value, the CPU 46 drives the pressure motor in a pressure-decreasing direction to thereby lower the output shaft. As a result, even if reactionary forces from the screen 22 detected at the right side and the left side of the squeegee 35 are different from each other during the printing step, the pressure motors 37 are driven to make the urging forces acting on the squeegee 35 balanced, thereby enabling the squeegee 35 to execute printing with appropriate urging forces.

Consequently, during the printing step, appropriate printing pressure can be maintained to carry out coating with a uniform thickness on an entire printing surface. As a result, it is possible to form high-density fine-line patterns, and other high precision coatings.

(2) In the present embodiment, in step 40, the pressure motors 37R and 37L are driven to bring the squeegee 35 into contact with a printing material P against the tension of the screen 22. This state in which the squeegee 35 is in contact with the printing material P is different from the state in which the output shafts 38R and 38L are in contact with the screen 22 alone by way of the squeegee holder 33 and the squeegee 35 so that the detected pressure changes sharply. Therefore, to maintain this state of the squeegee in which the pressure has sharply changed as a zero actual printing pressure state, the driving of the pressure motors 37R and 37L is stopped and the output shafts 38R and 38L are held in the above-mentioned state. Then, in step 50, the squeegee urging force-setting data are read from the RAM 46b, and based on this setting data (setting values), the pressure motors 37R and 37L are driven from this zero actual printing pressure state to a state in which the detected pressure values become equal to the urging force-setting values.

Thus, the actual printing pressure applied to the squeegee 35 is easily increased from zero to that of the urging force-setting value.

(3) Further, in the present embodiment, the opposite ends of the squeegee holder 33 are held by the pair of air float cylinders 31R and 31L. As a result, the squeegee holder 33 is supported at two points in a floating manner, whereby if urging forces acting on the squeegee are varied, the squeegee holder 33 can be supported in a stable manner.

(4) Since a linear motor is used as each pressure motor 37, urging forces applied to the squeegee are accurately controlled in comparison with a case where air cylinders are used as urging means. The urging forces of the air cylinders may be controlled by 0.1 Kg unit, whereas the urging forces of the pressure motors can be controlled by 0.01 Kg unit. An available maximum urging force is 120 Kg regardless of kinds of the urging means.

Although only one embodiment of the present invention has been described herein, it should be apparent to those skilled in the art that the present invention may be embodied in many other specific forms without departing from the spirit or scope of the invention. For example, the present invention may be embodied as follows:

(a) Although in the above embodiment, the vertical driving means is implemented by the AC servo motor 24, this is not limitative, but it may be implemented by an air cylinder.

(b) Although in the above embodiment, the pressure motors 37R and 37L are employed, this is not limitative, but they may be displaced by air cylinders. It is essentially required that employed devices are capable of performing high precision feedback control.

(c) The pressure motor may be controlled such that the urging forces are kept constant during an entire period of printing for a single printing material P by way of detecting the urging forces applied to the squeegee at the times of starting, executing and terminating the printing operation for each printing material P. In this case, an uniform ink coating can be made on the surface of each printing material P.

(d) In addition to controlling the urging forces to the squeegee by using the pressure motors, a detector may be provided for detecting the parallelism of the squeegee to control the position of the squeegee in response to signals supplied from the detector. In this case, even if the printing pressure is extremely low, for example, 0.01 Kg, the fine variations of the parallelism of the squeegee can be corrected to ensure accurate parallelism.

Next, technical spirits, which can be appreciated by reading the foregoing embodiments, other than those of the inventions set forth in the appended claims will be described together with effects.

A screen printing apparatus according to the second invention, wherein the first control means controls the urging means such that differences between setting values of urging forces of the urging force-setting means and values detected by the urging force-detecting means, respectively, are reduced to zero, to make the urging forces detected by the urging force-detecting means balanced. This adjusts the parallelism of the squeegee based on the setting values of the urging force-detecting means to thereby enable the squeegee to be maintained in a horizontal state.

According to the first and second inventions, the adjustment of parallelism of the squeegee can be carried out even during printing, thereby making it possible to carry out coating with a uniform thickness, as well as printing or coating of high-density fine-line patterns. Further, the advantageous effects of enhanced printing efficiencies can be also obtained.

Further, according to the second invention, it is possible to set an actual printing pressure applied to the squeegee to zero and then apply a predetermined urging force to the squeegee. This makes it possible to properly set the urging forces with ease.

Therefore, the present examples and embodiment are to be considered as illustrative and not restrictive, and the invention is not to be limited to the details given herein, but may be modified within the scope of the appended claims.

What is claimed is:

1. A screen printing apparatus comprising:

a squeegee arranged above a screen in a manner opposed to said screen, said squeegee being supported such that said squeegee is movable in a vertical direction and at the same time moveable in a direction along said screen for printing;

a plurality of urging means arranged on a supporting frame supporting said squeegee in a manner suspended therefrom, for urging said squeegee toward said screen;

moving means coupled to said squeegee for moving said squeegee along said screen for printing;

urging force-detecting means for detecting urging forces of said urging means while said moving means moves said squeegee along said screen for printing, said urging force-detecting means being connected to said squeegee to detect urging forces in response to movement of said squeegee along said screen during printing; and first control means for controlling said urging means based on a negative result of detection by said urging force-detecting means indicating that the urging forces are not in a desired state and to adjust the urging forces applied by said urging means to said squeegee while said moving means moves said squeegee along said screen during printing so that the urging forces detected by said urging force-detecting means are in the desired state.

2. The screen printing apparatus according to claim 1, wherein said first control means is a central processing unit (CPU).

3. The screen printing apparatus according to claim 2, wherein said central processing unit (CPU) comprises a ROM storing control programs, and a RAM as readable and writable memory means for storing input and output data and operation results.

4. The screen printing apparatus according to claim 3, wherein, when reactionary forces acting on a right side and a left side of said squeegee are different from each other, said central processing unit (CPU) drives pressure motors to elevate or lower output shafts of said pressure motors such that said urging forces acting on said squeegee become equal to respective setting values stored in said RAM to thereby change urging forces acting on said squeegee.

5. The screen printing apparatus according to claim 1, wherein said first control means controls said urging means such that urging forces respectively acting on a left side end and a right side end of said squeegee become equal to each other.

6. The screen printing apparatus according to claim 1, wherein said urging means comprises pressure motors.

7. The screen printing apparatus according to claim 6, wherein the pressure motors include linear motors.

8. The screen printing apparatus according to claim 1, wherein said urging force-detecting means comprises pressure sensors.

9. The screen printing apparatus according to claim 1, including a print head frame supporting said supporting frame and having vertical driving means for driving said supporting frame in a vertical direction, said print head frame being coupled to said moving means, wherein said moving means moves said print head frame in a direction of printing in a reciprocating manner;

floating support means arranged on said supporting frame for supporting said squeegee in a floating state relative to said supporting frame;

second control means for controlling driving of said urging means to thereby set actual printing pressure acting on said squeegee to 0 when said squeegee has been moved by way of said supporting frame to be brought into contact with said screen by said vertical driving means; and urging force-setting means for setting urging forces which are to be applied to said squeegee by way of said urging means after said actual printing pressure acting on said squeegee is adjusted to assume 0 by said second control means;

wherein said first control means controls said urging means in a manner such that values of said urging force detected by said urging force-detecting means are balanced when said urging force-detecting means detects that said urging forces are not balanced.

10. The screen printing apparatus according to claim 9, wherein said first control means controls said urging means in a manner such that differences between setting values set by said urging force-setting means and values detected by said respective urging force-detecting means are reduced to zero to thereby make balanced said values of urging forces detected by said urging force-detecting means.

11. The screen printing apparatus according to claim 9, wherein said first control means and said second control means are formed by a central processing unit (CPU).

12. The screen printing apparatus according to claim 11, wherein said central processing unit (CPU) comprises a ROM storing control programs, and a RAM as readable and writable memory means for storing input and output data and operation results.

13. The screen printing apparatus according to claim 12, wherein, when reactionary forces acting on a right side and a left side of said squeegee are different from each other, said central processing unit (CPU) drives pressure motors to elevate or lower output shafts of said pressure motors such that said urging forces acting on said squeegee become equal to respective setting values stored in said RAM to thereby change urging forces acting on said squeegee.

14. The screen printing apparatus according to claim 9, wherein said first control means and said second control means control said urging means such that urging forces respectively acting on a left side end and a right side end of said squeegee become equal to each other.

15. The screen printing apparatus according to claim 9, wherein said urging means comprises pressure motors or air cylinders.

16. The screen printing apparatus according to claim 9, wherein said urging force-detecting means comprises pressure sensors.

17. The screen printing apparatus according to claim 9, wherein said floating support means of said squeegee comprises air float cylinders.

18. The screen printing apparatus according to claim 9, wherein said vertical driving means is an AC servo motor or an air cylinder.

19. A screen printing apparatus comprising:

a screen for receiving ink;

a squeegee located above the screen and opposed to the screen for moving across the screen during a printing operation, wherein the squeegee is supported to be movable toward and away from the screen and parallel to the screen;

an urging mechanism for supporting the squeegee and for urging the squeegee toward the screen during printing;

moving means coupled to said squeegee for moving said squeegee across the screen during printing;

urging force detectors for detecting urging forces applied to the squeegee while said moving means moves said squeegee across the screen during printing, wherein the urging force detectors are connected to the squeegee to directly sense force applied to the squeegee while said moving means moves said squeegee across the screen during printing; and a controller for feedback controlling the forces by which the urging mechanism urges the squeegee toward the screen and for thus controlling the forces applied to the squeegee while said moving means moves said squeegee across the screen during printing, wherein the controller receives signals from the urging force detectors during the printing of an object, and the controller adjusts the urging mechanism during the printing motion that generated the signals when the signals indicate that the urging forces fall outside of a predetermined state.

20. A screen printing apparatus comprising:

a screen for receiving ink;

a squeegee located above the screen and opposed to the screen for moving across The screen in a printing operation, wherein the squeegee is supported to be movable toward and away from the screen and parallel to the screen, wherein the squeegee has two opposite ends;

at least a pair of urging devices for supporting the squeegee and for urging the squeegee toward the screen during printing;

moving means coupled to said squeegee for moving said squeegee across the screen during printing;

urging force detectors for detecting urging forces applied to the squeegee while said moving means moves said squeegee across the screen during printing, wherein an urging force detector is located near each end of the squeegee to directly sense forces applied to the squeegee during printing; and a controller for feedback controlling the forces by which the urging devices urge the squeegee toward the screen and for thus controlling the forces applied to the squeegee while said moving means moves said squeegee across the screen during printing, wherein the controller receives signals from the urging force detectors during the printing of an object, and the controller controls the urging mechanism during the printing motion that generated the signals to apply approximately the same force to each end of the squeegee when the signals indicate that the forces applied to each end of the squeegee are not approximately the same.

* * * * *